US006384525B1

(12) United States Patent
Sano et al.

(10) Patent No.: US 6,384,525 B1
(45) Date of Patent: May 7, 2002

(54) CATHODE-RAY TUBE HAVING A NON-CIRCULAR YOKE SECTION

(75) Inventors: Yuuichi Sano, Fukaya; Hideo Mori, Omiya, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/445,823

(22) PCT Filed: Apr. 13, 1999

(86) PCT No.: PCT/JP99/01962

§ 371 Date: Dec. 14, 1999

§ 102(e) Date: Dec. 14, 1999

(87) PCT Pub. No.: WO99/53516

PCT Pub. Date: Oct. 21, 1999

(30) Foreign Application Priority Data

Apr. 14, 1998 (JP) ..... 10-102643

(51) Int. Cl.[7] ..... H01J 29/70; H01J 31/00
(52) U.S. Cl. ..... 313/440; 313/477 R
(58) Field of Search ..... 313/440, 461, 313/477 R, 472, 473, 474, 475, 476; 220/2.1 A, 2.1 R

(56) References Cited

U.S. PATENT DOCUMENTS

| | | | | |
|---|---|---|---|---|
| 3,731,129 A | | 5/1973 | Tsuneta et al. | 313/64 |
| 5,214,348 A | * | 5/1993 | Nakamura et al. | 313/477 R X |
| 5,763,995 A | * | 6/1998 | Sano et al. | 313/477 R |
| 5,929,559 A | * | 7/1999 | Sano et al. | 313/477 R |
| 5,962,964 A | * | 10/1999 | Sano et al. | 313/440 |
| 6,002,203 A | * | 12/1999 | Yokota et al. | 313/477 R |
| 6,087,767 A | * | 7/2000 | Sano et al. | 313/440 |
| 6,208,068 B1 | * | 3/2001 | Lee et al. | 313/477 R |
| 6,268,692 B1 | * | 7/2001 | Yokota et al. | 313/477 R |

FOREIGN PATENT DOCUMENTS

| | | |
|---|---|---|
| JP | 48-34349 | 10/1973 |
| JP | 48-85030 | 11/1973 |
| JP | 56-63757 | 5/1981 |
| JP | 9-306388 | 11/1997 |

* cited by examiner

*Primary Examiner*—Vip Patel
*Assistant Examiner*—Mack Haynes
(74) *Attorney, Agent, or Firm*—Pillsbury Winthrop LLP

(57) ABSTRACT

In an increased-diameter funnel section and a almost pyramidal decreased-diameter yoke section constituting the funnel section of the envelope of a cathode-ray tube, the outside surface of the yoke section between a neck connecting portion on which a neck and the yoke section are coupled and a position close to a boundary of a increased funnel section, on which deflection yoke is provided, is shaped so as to fulfill the following expression:

$$0.00 \leqq (\alpha 0 - \alpha \min) \leqq 0.04$$

where the index value indicating the degree of rectangle at the deflection reference position is $\alpha 0$ and the minimum of the index values in the whole area of the yoke section is $\alpha \min$. This makes it possible to provide a cathode-ray tube apparatus which secures a sufficient strength of the vacuum envelope to atmospheric pressure even when the yoke section is made pyramidal and which reduces the deflection power effectively and thereby fulfills the demands for higher luminance and higher-frequency deflection.

2 Claims, 4 Drawing Sheets

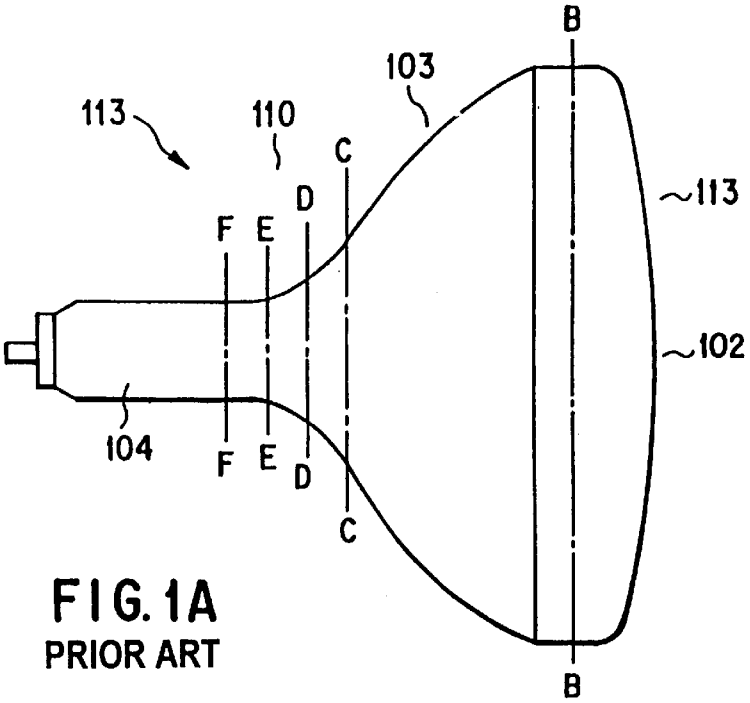
FIG.1A
PRIOR ART
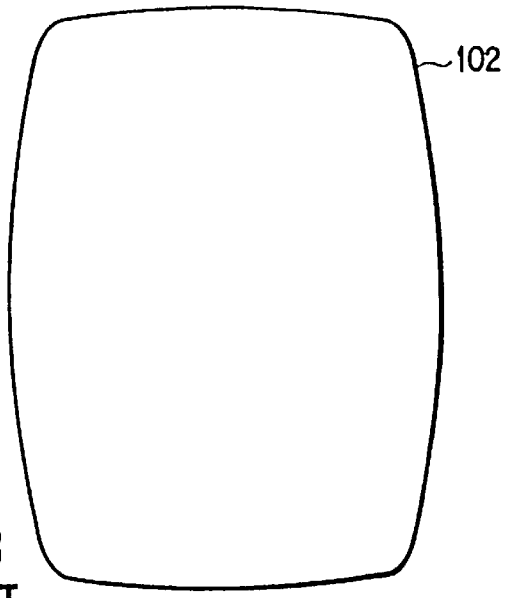
FIG.1B
PRIOR ART
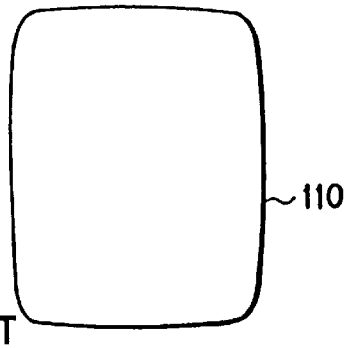
FIG.1C
PRIOR ART
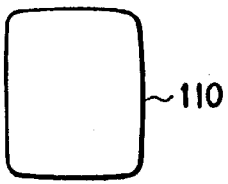
FIG.1D
PRIOR ART
FIG.1E
PRIOR ART
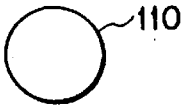
FIG.1F
PRIOR ART

CATHODE-RAY TUBE HAVING A NON-CIRCULAR YOKE SECTION

TECHNICAL FIELD

This invention relates to a cathode-ray tube, such as a color cathode-ray tube, and more particularly to a cathode-ray tube apparatus capable of reducing the deflection power effectively and securing the strength of the vacuum envelope to atmospheric pressure.

BACKGROUND ART

A cathode-ray tube, such as a color picture tube, has a vacuum envelope made of glass and composed of a panel with an almost rectangular display section, a funnel connected to the panel, and a neck of cylindrical shape connected to the funnel. A deflecting yoke is provided between the neck and the funnel. The funnel has a decreased-diameter section, or a yoke section, ranging from the junction with the neck to the position where the deflecting yoke is provided.

On the inside face of the effective portion of the panel, a fluorescent screen composed of a three-color fluorescent layer of blue-, green-, and red-fluorescent dots or stripes is provided. Inside the panel, a shadow mask in which a large number of electron beam passing holes have been made is provided so as to face the fluorescent screen. In the neck, an electron gun assembly assembly for generating three electron beams is provided. The electron beams are deflected horizontally and vertically by horizontal and vertical deflection fields generated by the deflecting yoke and directed to the fluorescent screen via the shadow mask. Then, the electron beams scan the fluorescent screen horizontally and vertically, thereby causing a color image to appear on the screen.

One color picture tube of such a type is a self convergence in-line color tube, which has been widely used. In the self convergence in-line color tube, the in-line electron gun assembly produces in-line three electron beams passing in the same horizontal plane. The three electron beams in a line emitted from the electron gun assembly are deflected by a pincushion horizontal deflection magnetic field and a barrel vertical deflection magnetic field both generated by the deflection yoke, thereby causing the three electron beams in a line to converge together all over the screen without using special correction means.

In such a cathode-ray tube, the deflecting yoke is a heavily power consuming source. To reduce the power consumption of the cathode-ray tube apparatus, it is important to reduce the power consumption of the deflecting yoke. To increase the screen luminance, the cathode voltage to accelerate the electron beams must eventually be raised. In addition, to meet the requirements for OA devices, such as HD (High Definition) TVs or PCs (Personal Computers), the deflection frequency has to be increased. Both the raised cathode voltage and the increased deflection frequency result in an increase in the deflection power.

In the case of OA devices, such as PCs, which the operator uses sitting close at the cathode-ray tube, magnetic fields leaking from the deflecting yoke to the outside of the cathode-ray tube, or leakage magnetic fields, have been regulated strictly. A widely used means of reducing the magnetic field leaking from the deflecting yoke to the outside of the cathode-ray tube is to add a compensating coil. The addition of the compensating coil, however, results in an increase in the power consumption.

To reduce the deflection power or the leakage magnetic field, the diameter of the neck of a cathode-ray tube should be made smaller and therefore the outside diameter of the yoke section on which the deflecting yoke is installed is made smaller, thereby making the acting space of the deflecting magnetic field smaller, which allows the deflecting magnetic field to act on the electron beams efficiently.

In a conventional cathode-ray tube, since the electron beams pass near the inside face of the yoke section installed on the deflecting yoke, the still smaller neck diameter and yoke outside diameter permit the electron beams advancing toward the diagonal section of the fluorescent screen at the maximum deflection angle to impinge on the inner wall of the yoke section, which allows a portion where no electron beam impinges to appear on the fluorescent screen. As a result, with the conventional cathode-ray tube, it is difficult to reduce the deflection power by making the neck diameter and yoke section outside diameter smaller. If electron beams continue striking the inner wall of the yoke section, the temperature at the impinged portion will rise so high that the glass will melt, leading to the danger of implosion.

A means for solving such a problem has been disclosed in Jpn. Pat. Appln. KOKOKU Publication No. 48-34349 (U.S. Pat. No. 3,731,129). In the publication, the yoke section 110 of the funnel 103 on which a deflecting yoke is installed is shaped so that its form changes gradually from round at the neck 104 to almost rectangular at the panel 102, as shown in FIGS. 1B to 1F, which are sectional views taken along line B—B to F—F, respectively, in an cathode-ray tube 113 of FIG. 1A. The shape is based on the idea that, when a rectangular raster is drawn on the fluorescent screen, the area through which the electron beams pass should take the form of an almost rectangular shape.

The formation of the yoke section 110 on which the deflecting yoke is installed into a pyramid shortens the major axis (horizontal axis: H-axis) and minor axis (vertical axis: V-axis) of the deflecting yoke. Therefore, bringing the horizontal and vertical deflection coils of the deflecting yoke close to the electron beams enables the beams to deflect efficiently, which helps reduce the deflection power. With such a cathode-ray tube, as the yoke section is made more rectangular to reduce the deflection power effectively, the strength of the vacuum envelope to atmospheric pressure decreases due to the distortion of the glass, impairing safety.

Recently, there have been strong demands toward external light reflection and easy-to-see pictures. Thus, it is indispensable to make the panel flatter. Since the flatter panel surface of the cathode-ray tube decreases the vacuum strength, direct use of the conventional funnel with the pyramidal yoke section would fail to secure the bulb strength necessary for safety.

For this reason, there has been a problem of being unable to make the cross section of the yoke section rectangular enough to reduce the deflection power sufficiently. Another problem is that the strength of the bulb to atmospheric pressure is so low that it cannot be applied to a flat panel.

In connection with the technique for shaping the yoke section into a pyramid, in about 1970, the applicant mass-produced two series of cathode-ray tubes: one with a deflection angle of 110°, a neck diameter of 36.5 mm, and panel diagonal diameters of 18", 20", 22", and 26", and the other with a deflection angle of 110°, a neck diameter of 29.1 mm, and panel diagonal diameters of 16" and 20". At that time, the technique was applied to a cathode-ray tube called a 1R tube (hereinafter, referred to as a 1R square yoke section tube), the outer surface of whose panel was almost spherical, the curvature radius of the panel outer surface being about 1.7 times the screen diagonal effective diameter. As for cathode-ray tubes the curvature radius of whose panel outer surface was twice or more the screen diagonal effective diameter, the relationship between the shape of the yoke section and the strength of the bulb was unknown.

As described above, recently, there have been demands toward reducing the deflection power and leakage magnetic field in a cathode-ray tube apparatus. It is very difficult to meet the demands while achieving higher luminance and higher frequency required for OA devices, including HD TVs and PCs. A conventional structure to reduce the deflection power is such that a pyramidal yoke section changing from round at the neck to almost rectangular at the panel is formed on the yoke section on which a deflecting yoke is to be installed. Although such a structure has been proposed, it is difficult to produce a vacuum envelope that not only ensures a sufficient strength to atmospheric pressure but also reduces the deflection power sufficiently.

DISCLOSURE OF INVENTION

The object of the present invention is to provide a cathode-ray tube apparatus which not only secures a sufficient strength of the vacuum envelope to atmospheric pressure even when the yoke section is made pyramidal but also reduces the deflection power effectively, thereby meeting the demands for higher luminance and higher-frequency deflection.

The present invention has been centered on the funnel of the enclosure of a cathode-ray tube, particularly on the shape of the yoke section. The funnel section is part of the vacuum envelope between the panel section having a fluorescent screen on its inside face and the neck section having an electron gun assembly in it and connects the panel section to the neck section. The funnel section is composed of a panel-side increased-diameter funnel section (a first section), and a neck-side decreased-diameter, almost pyramidal yoke section (a second section).

In the present invention, with at least one cross section perpendicular to the tube axis of the yoke section being made noncircular and allowed to have an outside diameter of the yoke section that becomes the largest between the directions of vertical axis and horizontal axis of the screen, if the outside diameter of the yoke section in the vertical direction is SA, the outside diameter of the yoke section in the horizontal direction is LA, and the maximum outside diameter of the yoke section is DA, an index value a indicating the degree of rectangle for the noncircular shape is defined as $$\alpha=(SA+LA)/(2*DA).$$

Under these conditions, the yoke section is so formed that it meets the following expression:

$$0.00 \leqq (\alpha 0 - \alpha min) \leqq 0.04$$

where $\alpha 0$ is the index value at the deflection reference position and $\alpha min$ is the minimum of the index values in the whole area of the yoke section.

Furthermore, the yoke section is so formed that it meets the following expression with respect to the index value $\alpha 0$ indicating the degree of rectangle at the deflection reference position:

$$-0.04 \leqq (\alpha 0 - \alpha s) \leqq 0.04$$

wherein $\alpha s$ is the index value of the degree of rectangle at a position between the deflection reference position on the yoke section and the screen-side end of the yoke section.

BRIEF DESCRIPTION OF DRAWINGS

FIG. 1A is a schematic side view of a conventional cathode-ray tube apparatus with a pyramidal yoke section;

FIGS. 1B to 1F are sectional views taken along line B—B to line F—F of FIG. 1A, respectively;

BEST MODE OF CARRYING OUT THE INVENTION

Figure 2:
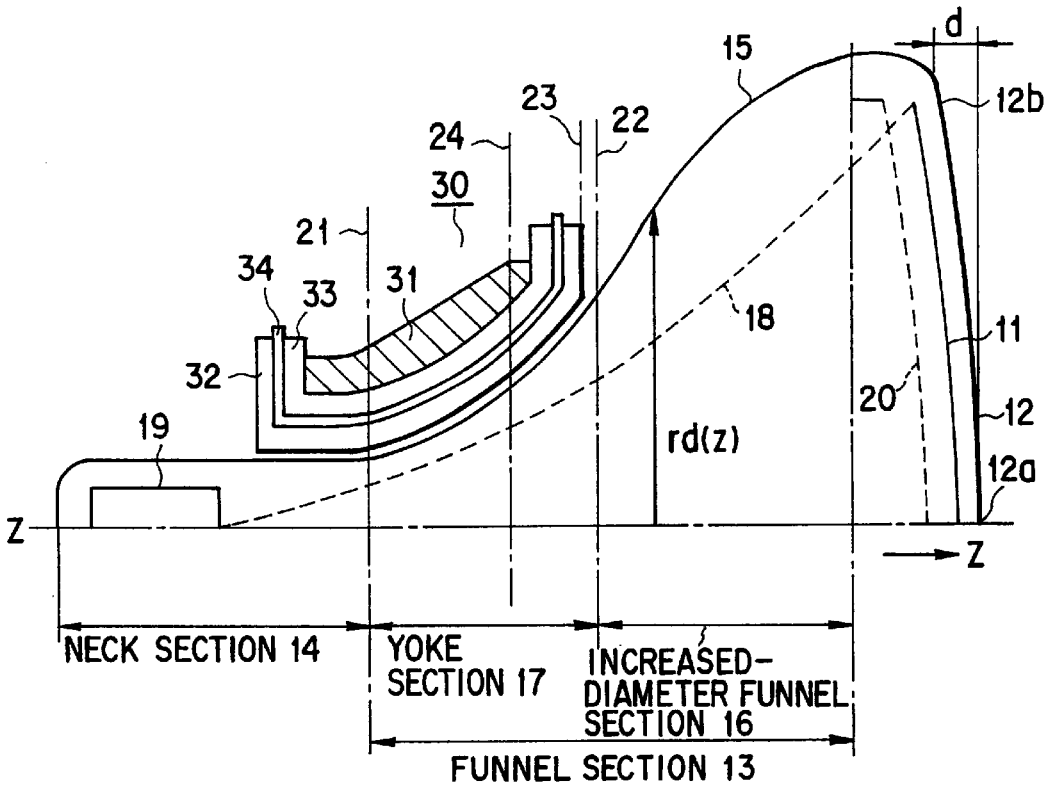
FIG. 2 is a schematic sectional view of the upper half of a cathode-ray tube according to an embodiment of the present invention, taken along the tube axis.
Figure 3:
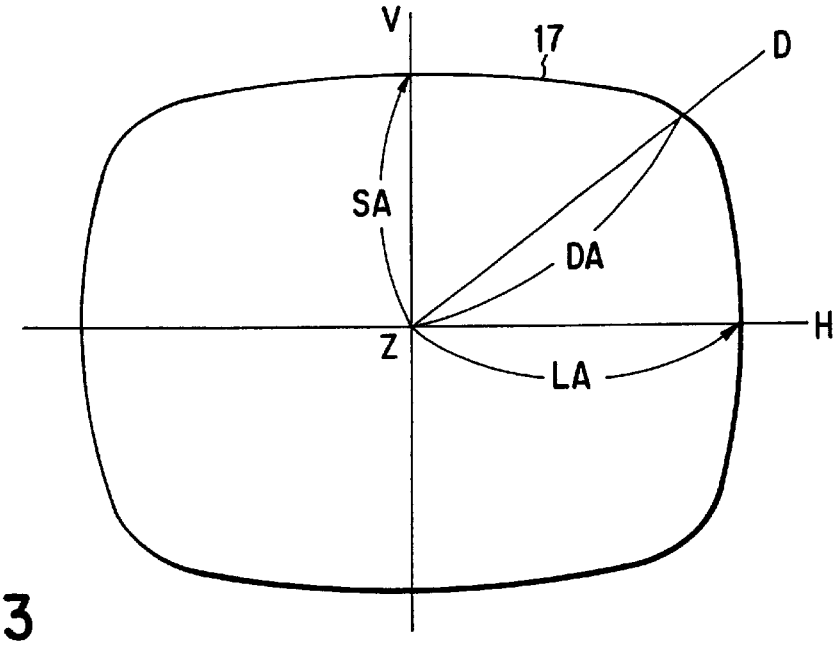
FIG. 3 is a sectional view of the yoke section of the cathode-ray tube in FIG. 2, taken along a plane perpendicular to the tube axis.

FIG. 2 is a sectional view of a cathode-ray tube according to an embodiment of the present invention. FIG. 3 is a sectional view taken along a plane perpendicular to the tube axis, illustrating the shape of the outer surface of the yoke section in the cathode-ray tube of FIG. 2.

The cathode-ray tube of FIG. 2 has a vacuum envelope 15 composed of a panel section 12 on whose inside face a fluorescent screen 11 is formed, a funnel section 13 connected to the panel section 12, and a cylindrical neck section 14 connected to the funnel section 13. The funnel section 13 is made up of an increased-diameter funnel section 16 close to the panel and a decreased-diameter semi-pyramidal yoke section 17 close to the neck.

A saddle-saddle defecting yoke 30 is so installed that it covers from the neck section 14 to the funnel section 13. In the deflecting yoke 30, a pyramidal magnetic material core section 31 whose cross section is noncircular is placed on its outside and a horizontal and a vertical coil 32, 33 are arranged on its inside.

The fluorescent screen 11 formed on the panel inside face is composed of plural fluorescent layers glowing red, green, and blue respectively. An electron gun assembly 19 emitting plural electron beams 18 corresponding to the glowing colors is provided in the neck section 14. On the inside of the panel between the electron gun assembly 19 and the fluorescent surface, a shadow mask 20 with a color selecting function is so provided that it is fixed to a frame. The shadow mask shapes the electron beams 18 emitted from the electron gun assembly 19 and projects a beam spot on a fluorescent layer of a particular color.

In the color picture tube, the electron gun assembly 19 is of the in-line type that emits three electron beams in a line, as in the prior art. The three electron beams in a line emitted from the electron gun assembly 19 are deflected by a pincushion horizontal deflection magnetic field and a barrel vertical deflection magnetic field both generated by the deflecting yoke 30 with the noncircular core section 31, thereby causing the three electron beams 18 in a line to converge together all over the screen without using special correction means.

In the cross section of the yoke section of FIG. 3, let the distances from the tube axis Z to the outer surface of the yoke section in the directions of horizontal axis H, vertical axis V, and diagonal axis D be LA, SA, DA, respectively:

then, in the pyramidal yoke section, each of the horizontal and vertical distances LA and SA is shorter than the diagonal distance DA. Consequently, the deflecting coils placed on the horizontal and vertical axes can be brought closer to the electron beams, leading to a decrease in the deflection power. The diagonal axis distance DA corresponding to the maximum diameter is the distance along the diagonal axis of the screen and might be unequal to the exactly diagonal distance.

Figure 4:
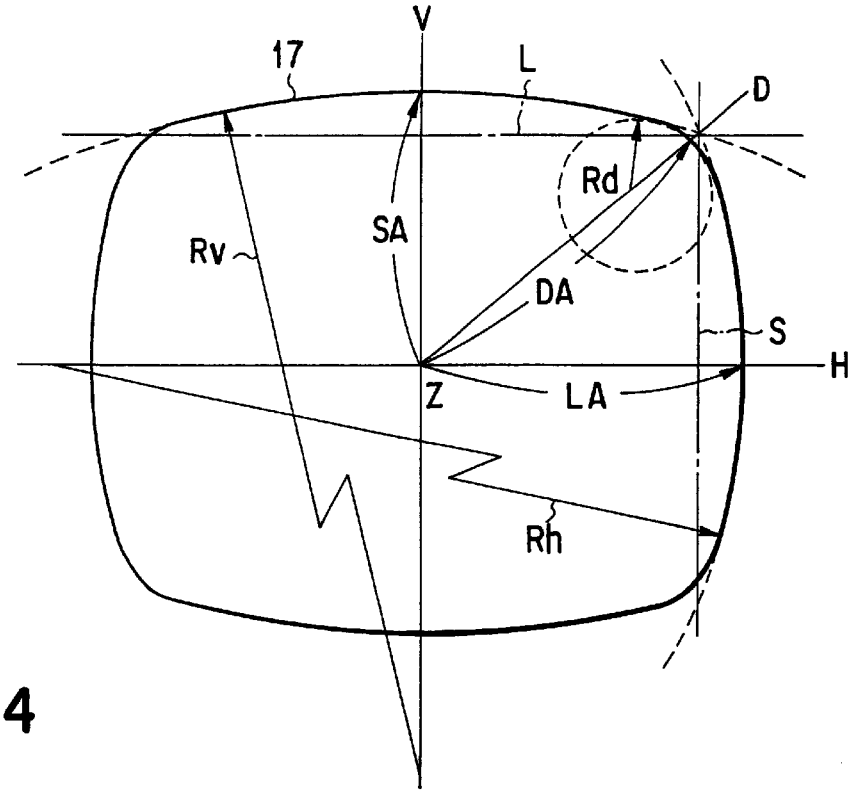
FIG. 4 is an explanatory diagram for the description of the shape of FIG. 3.

In addition to the distances along the three axes, the cross-sectional shape of the yoke section of FIG. 3 is defined by a circular arc with a radius of Rh having the center on the horizontal axis, a circular arc with a radius of Rv having the center on the vertical axis, and a circular arc with a radius of Rd having the center on or near the diagonal axis as shown in FIG. 4. In this case, the cross-sectional shape of the yoke section as shown in FIG. 3 is defined by connecting the circular arcs and the curves determined by the vertical, horizontal, and diagonal distances. The cross-sectional shape may be defined as a semi-rectangular cross section, using various numerical formulas.

Regarding the cross-sectional shape of the outer surface of the yoke section as shown in FIG. 3, if the outside diameter of the yoke section along the vertical axis is SA, the outside diameter of the yoke section along the horizontal axis is LA, and the (maximum) outside diameter of the yoke section along the diagonal axis is DA, an index value $\alpha$ indicating the degree of rectangle is defined as:

$$\alpha=(SA+LA)/(2\times DA).$$

The index value $\alpha$ is such that as the index value becomes smaller, the shape changes from almost round closer to rectangular.

In a conventional cathode-ray tube with a 1R square yoke section, the yoke section is formed as follows. The index value $\alpha$ is $\alpha=1.0$ (round) at the junction with the neck section. From the point, the value decreases gradually toward the screen and becomes the smallest near the screen-side end of the yoke section. From there, the index value increases sharply and becomes $\alpha=1.0$ at the screen-side end of the yoke section.

When the yoke section in the 1R square yoke section tube is used directly for a cathode-ray tube the outside of whose panel has a flatness more than twice the curvature radius of the diagonal effective diameter of the panel, the strength of the enclosure necessary for safety cannot be secured. The flatness is expressed by the degree of flatness with which the panel outside surface is approximated to a round on the basis of the drop d toward the neck section along the tube axis Z between the panel center 12*a* and panel diagonal end 12*b* as shown in FIG. 2.

Figure 5:
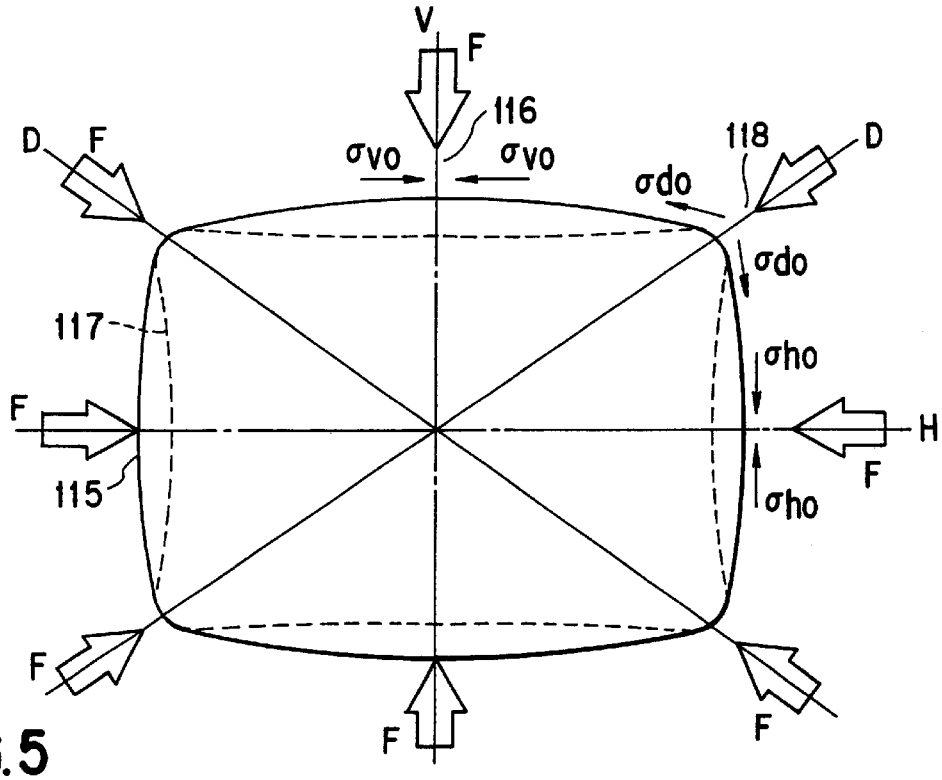
FIG. 5 is a diagram to help explain stresses occurring at the rectangular yoke section of FIG. 3.
Figure 6A:
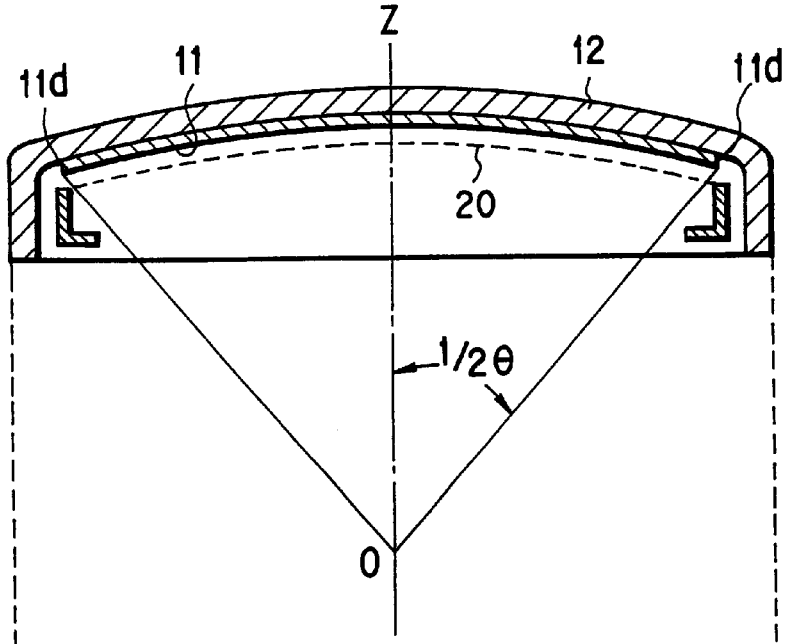
FIGS. 6A and 6B are a sectional view and plan view of the panel to help explain the position of the deflection center.
Figure 6B:
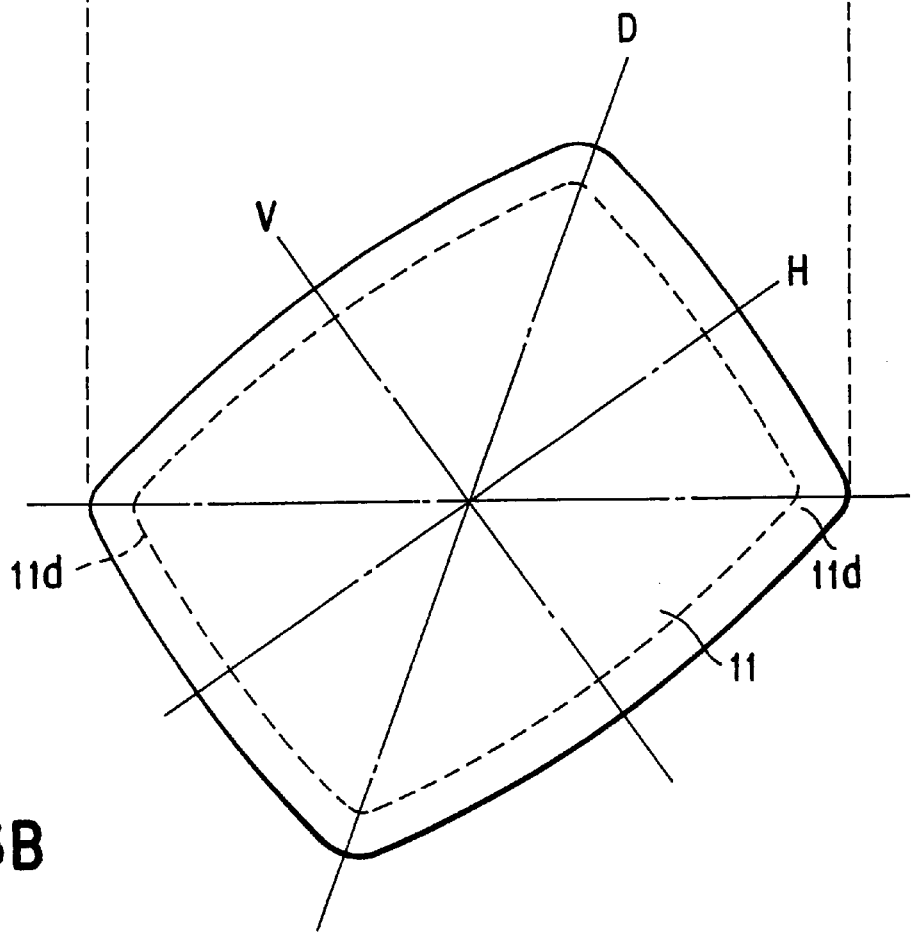

The problem of being unable to secure the strength of the enclosure will be described in detail below. When an atmospheric pressure load F is applied to the tube as shown in FIG. 5, the vicinity 115 of the horizontal axis and the vicinity 116 of the vertical axis in the flat yoke section are distorted in the direction of broken line 117. As a result, compressive stresses $\sigma$ho, $\sigma$vo develop at the outside surface of the yoke section around the horizontal axis and vertical axis. Since a large tensile stress ado develops at the outside surface of the yoke section in the vicinity of the diagonal axis 118, a crack appears starting near the diagonal axis 118 of the yoke section and therefore implosion is liable to take place.

In the yoke section of the cathode-ray tube, the outside diameter of the yoke section becomes larger gradually from the net section toward the screen. The larger the outside diameter of the yoke section is, the more the vicinity of the horizontal axis 115 and the vicinity of the vertical axis 116 of FIG. 5 are distorted because of the atmospheric pressure load F. Thus, to apply the square yoke section to a cathode-ray tube whose flatness has a curvature radius more than twice the screen diagonal effective diameter, it is necessary to shorten the length of the yoke section along the tube axis as much as possible. The shortened length of the yoke section, however, limits flexibility in designing the deflecting yoke. In addition, the characteristics of the deflection system must be considered for use in wide-angle deflection tubes. Taking into account the limitation and characteristics, the deflecting yoke magnetic path length (the length in the direction of tube axis) has to be extended. As a result, the yoke section of the bulb must also be extended accordingly. To improve the bulb strength of the cathode-ray tube with the pyramidal yoke section, the shape of the yoke section has only to be returned to a circular cone, which impairs the effect of reducing the deflection power.

The inventors of the present invention conducted various experiments, examined the results, and found that it is important to decrease the inside diameter of the magnetic material core of the deflecting yoke to reduce the deflection power. Specifically, since the screen-side end of the core is located near a deflection reference position (usually called a reference line) in deflecting the electron beams, making the yoke section rectangular in the deflection reference position is effective in reducing the deflection power. The rectangular yoke section increases the vacuum stress. It was at the part of the yoke section near the screen that the stress became the largest. Namely, the degree of rectangle of the yoke section near the screen is important from the viewpoint of the strength of the enclosure. Thus, the index value $\alpha$ at the screen-side end of the yoke section cannot be made too small for the index value $\alpha$ at the deflection reference position. Therefore, in a case where the square yoke section is made longer using a flat panel whose outer surface has a curvature radius more than twice the screen diagonal diameter, to reduce the deflection power effectively while securing the safe strength of the enclosure, the yoke section has to be so formed that the index value representing the degree of rectangle is made sufficiently small near the deflection reference position and the rate at which the index value $\alpha$ decreases is made lower than in the conventional 1R square tube.

The deflection reference position is defined as the position of the tube axis at which, when straight lines are extended from the screen diagonal axes 11*d* to point O where the tube axis z is located, the angle formed by the two straight lines is the maximum deflection angle $\theta$ determined in the cathode-ray tube apparatus.

Table 1 lists the index value a representing the degree of rectangle of the square yoke section in the embodiment. In Table 1, $\alpha$0 is the index value indicating the degree of rectangle of the outer surface of the yoke section at the deflection reference position, and $\alpha$min is the minimum of the index values in the area of the yoke section. The table also lists the maximum value of vacuum stress appearing at the enclosure and the strength of the enclosure at that time. The neck is almost round and cannot be made rectangular sharply toward the screen. Therefore, the value of $\alpha$min is taken at a position closer to the screen than the deflection reference position, as in the conventional 1R square yoke tube. In a first embodiment of the invention, the yoke section is made fully rectangular because $\alpha$0 is 0.83 at the deflection reference position. From this point, $\alpha$ decreases gradually toward the screen and takes the minimum value of $\alpha$min=

0.78, with the difference ($\alpha 0-\alpha min$) being 0.05. In this case, the maximum vacuum stress is 1350 psi, which is much larger than the stress value 1200 psi necessary to secure the strength of the enclosure for safety.

In a second embodiment of the invention, the value of $\alpha 0$ is the same as in the first embodiment but the value of $\alpha min$ is 0.80, which decreases the rate at which $\alpha$ decreases from the deflection reference position to the screen. In this case, the difference ($\alpha 0-\alpha min$) is 0.03 (($\alpha 0-\alpha min$)=0.03). The maximum vacuum stress is suppressed to 1140 psi, which secures the safe strength of the enclosure. Consequently, to set the maximum vacuum stress at 1200 psi, ($\alpha 0-\alpha min$) should be made about 0.04.

In the case of the conventional 1R square yoke tube, ($\alpha 0-\alpha min$) is 0.05 or more as in the first embodiment. When a panel with a high flatness is used, the shape does not allow the effective reduction of the deflection power to be compatible with the strength of the enclosure.

TABLE 1

| TYPE OF TUBE | $\alpha 0$ | Amin | ($\alpha 0$-$\alpha min$) | MAXIMUM VACUUM STRESS [psi] | STRENGTH OF ENCLOSURE |
|---|---|---|---|---|---|
| 1ST EMBODIMENT | 0.83 | 0.78 | 0.05 | 1359 | X |
| 2ND EMBODIMENT | 0.83 | 0.80 | 0.03 | 1140 | ○ |

As described above, the index value a indicating the degree of rectangle become the smallest at a position closer to the screen than the deflection reference position. When the shape of the yoke section is changed sharply from rectangular to round near the screen as in the 1R square yoke tube, this inevitably results in a smaller decrease in the deflection power, which is undesirable from the viewpoint of the strength of the enclosure. Therefore, there is a limit to allowing the index value to become the largest at a position closer to the screen side of the yoke section than the deflection reference position. It is desirable that the difference between the index value $\alpha 0$ and its maximum value at the deflection reference position should be 0.04 or less almost equal to the difference between the deflection reference position and the minimum value.

Specifically, if the outside diameter of the vertical deflecting yoke section is SA, the outside diameter of the horizontal yoke section is LA, and the maximum outside diameter of the yoke section is DA, an index value $\alpha$ indicating the degree of rectangle is defined as:

$$\alpha=(SA+LA)/(2\times DA).$$

Under the conditions, the yoke section is so formed that it meets the following expression:

$$0.00\leqq(\alpha 0-\alpha min)\leqq 0.04$$

where $\alpha 0$ is the index value at the deflection reference position and $\alpha min$ is the minimum of the index values in the whole area of the yoke section.

If an index value representing the degree of rectangle at an arbitrary point between the deflection reference position on the yoke section and the screen-side end of the yoke section is $\alpha s$, $\alpha s$ is made fulfill the following expression with respect to the index value $\alpha 0$ indicating the degree of rectangle at the deflection reference position:

$$-0.04\leqq(\alpha 0-\alpha s)\leqq 0.04$$

This makes it possible to provide a shape which secures the mechanical strength of the enclosure while assuring the effect or reducing the deflection power.

Hereinafter, the embodiment of the present invention will be explained by reference to the accompanying drawings.

The shape of the outer surface of the enclosure in a vertical section including the tube axis Z is such that it takes the form of an almost S-shaped curve from the funnel section 13 toward the neck section 14, projecting outward in the increased-diameter funnel section 16 and retracting in the yoke section 17. The boundary between the increased-diameter funnel section 16 and the yoke section 17 contains the inflection point 22 of the curve. Specifically, if a coordinate z is set on the tube axis Z and the proximity distance between the outer surface of the funnel section 13 and the tube axis Z in a vertical section in the direction of the screen diagonal axis D including the tube axis is rd(z), the inflection point 22 is determined by integrating rd(z) twice with respect to coordinate z and finding a position in which the result is zero. The yoke section 17 corresponds to the portion from the junction with the neck section 14 to the inflection point 22.

In the cathode-ray tube, the yoke section 17 on which the defecting yoke 30 is installed is so formed that its cross section is almost pyramidal (noncircular in a cross section perpendicular to the tube axis). The deflecting yoke 30 is also formed into a pyramid (or at least so formed that the inside of the cross section perpendicular to the tube axis is noncircular) so as to fit the almost pyramidal yoke section 17. The magnetic materiel core section 31 constitutes the deflecting yoke in such a manner that it encloses the outside of the assembly of a cylindrical synthetic resin frame 34 and is secured to it. The frame 34 is used to fasten the horizontal deflection coil 32 to its inside and the vertical defection coil 33 to its outside.

The deflecting yoke 30 is installed between the neck section 14 and the yoke section 17 in such a manner that the screen-side edge of the deflecting yoke (the edge of the windings of the horizontal deflection coil) 23 is positioned near the inflection point 22 on the funnel section. For this reason, the deflection reference position 24 is closer to the neck section than the inflection point 22.

In the embodiment, the shape from the position on the yoke section corresponding to the deflection reference position 24 to the inflection point 22, or to the boundary with the increased-diameter funnel section 16 is determined as follows.

FIG. 3 is a sectional view of the pyramidal yoke section 17 of the present invention taken along a plane perpendicular to the tube axis. In FIG. 3, it is assumed that the distance from the tube axis Z to the outer surface of the yoke section is the outside diameter of the yoke section. On this assumption, SA is the outside diameter of the yoke section in the direction of vertical axis, LA is the outside diameter of the yoke section in the direction of horizontal axis, and DA is the (maximum) outside diameter of the yoke section in the direction of diagonal axis. As shown in the figure, the yoke section has an almost rectangular cross section.

The rectangular cross section of the yoke section in the position corresponding to the deflection reference position 24 measures DA=30.0 mm, LA=27.3 mm, and SA=22.4 mm. The index value indicating the degree of rectangle is:

$$\alpha 0=0.83.$$

The minimum of the index values a in the yoke section 17 is closer to the screen than the deflection reference position. The rectangular cross section of the yoke section in the position corresponding to the minimum position measures DA=61.3 mm, LA=53.3 mm, and SA=44.3 mm. The index value indicating the degree of rectangle is:

$$\alpha min=0.80.$$

As described above, the index value indicating the degree of rectangle $\alpha$ in the yoke section 17 is defined as the index $\alpha\mathbf{0}=0.80$ in the deflection reference position 24 and also defined as the index $\alpha min=0.80$ at a position close to the intermediate portion of the boundary 22 between the deflection reference position 24 and the increased-diameter funnel section. The index $\alpha$ is increased from this position and the index $\alpha$ is defined as $\alpha=0.82$ in the boundary 22 of the increased-diameter funnel section. That is, inequality $(0.00 \leqq (\alpha\mathbf{0}-\alpha min) \leqq 0.04)$ is established and the yoke section is so shaped as to have an arbitrary index $\alpha s$ which satisfy the inequality $(-0.04 \leqq (\alpha\mathbf{0}-\alpha s) \leqq 0.04)$ in a position between the deflection reference position of the yoke section and the screen-side end of the yoke section.

As compared with the conventional cathode-ray tube with the conic yoke section, the embodiment reduces the horizontal deflection power by about 20% and the leakage magnetic field by half. The vacuum stress developing in the enclosure is 1140 psi. Therefore, the embodiment assures a safe strength of the vacuum envelope.

INDUSTRIAL APPLICABILITY

According to the shape of the yoke section according to the present invention, there is provided a cathode-ray tube apparatus which secures a sufficient strength of the vacuum envelope to atmospheric pressure even when the yoke section is made pyramidal and which reduces the deflection power effectively and thereby fulfills the demands for higher luminance and higher-frequency deflection.

What is claimed is:

1. A cathode-ray tube apparatus comprising:

an electron gun assembly for emitting electron beams;

a vacuum envelope having a tube axis, including:

a panel section having at least an almost rectangular fluorescent screen on its inside face;

a neck section having said electron gun assembly in it, the electron gun assembly being placed so as to face said screen;

an increased-diameter funnel section, between said panel section and said neck section, that connects said panel section to said neck section, and is located closer to said panel section;

a funnel section being composed of an almost pyramidal yoke section located close to said neck section; and a deflecting yoke which is placed on the outside surface of said vacuum envelope between said yoke section and said neck section and includes a horizontal deflection coil, a vertical deflection coil, and a magnetic material core that deflect the electron beams emitted from said electron gun assembly toward an almost rectangular screen area, said cathode-ray tube apparatus wherein a tube-axis coordinate z is taken in the direction of the axis of said vacuum envelope with the screen side being positive, the proximity distance between said tube axis and the outer surface of said funnel section in a cross section in the direction of screen diagonal axis including said tube axis is rd(z), said yoke section is an area curved inwardly toward the tube axis in such a manner that the second-order differential of said rd(z) with respect to said z gives a positive value, and the position of the boundary with said increased-diameter funnel section of said yoke section is made an inflection point where the second-order differential of said rd(z) with respect to said z is zero, a point on the tube axis at which the angle formed by straight lines connecting the diagonal axes of said almost rectangular screen to a point close to said electron gun assembly is half the deflection angle of said cathode ray tube is used as deflection reference position, and if the distance between the tube axis and the outside surface of said yoke section in a cross section perpendicular to said tube axis is the outside diameter of the yoke section, at least one cross section is noncircular and has an outside diameter of the yoke section in the vertical direction is SA, the outside diameter of the yoke section in the horizontal direction is LA, and the maximum outside diameter of the yoke section is DA, and index value a indicating the degree of rectangle for said noncircular shape is defined as $$\alpha=(SA+LA)/(2\times DA) \text{ and}$$

$\alpha\mathbf{0}$ is the index value at the deflection reference position and a min is the minimum of the index values in the whole area of the yoke section, the following expression is fulfilled:

$$0.0 \leqq (\alpha\mathbf{0}-\alpha min) \leqq 0.04$$

2. A cathode-ray tube apparatus according to claim 1, wherein the index value indicating the degree of rectangle at a position between the deflection reference position of said yoke section and the screen-side end of the yoke section is $\alpha s$, and the following expression is fulfilled with respect to the index value $\alpha\mathbf{0}$ indicating the degree of rectangle at said defection reference position:

$$-0.04 \leqq (\alpha\mathbf{0}-\alpha s) \leqq 0.04.$$

* * * * *